US008444145B2

(12) United States Patent
Cercone

(10) Patent No.: US 8,444,145 B2
(45) Date of Patent: May 21, 2013

(54) WRIST SUPPORT AND HAND GRIP

(75) Inventor: Peter Cercone, Tallinn (EE)

(73) Assignee: Videob Holdings Limited, Road Town (VG)

( * ) Notice: Subject to any disclaimer, the term of this patent is extended or adjusted under 35 U.S.C. 154(b) by 147 days.

(21) Appl. No.: 13/127,853

(22) PCT Filed: Nov. 1, 2009

(86) PCT No.: PCT/IB2009/054839

§ 371 (c)(1),
(2), (4) Date: May 5, 2011

(87) PCT Pub. No.: WO2011/051755

PCT Pub. Date: May 5, 2011

(65) Prior Publication Data

US 2012/0270656 A1 Oct. 25, 2012

Related U.S. Application Data

(60) Provisional application No. 61/113,423, filed on Nov. 11, 2008.

(51) Int. Cl.
*A63F 11/00* (2006.01)

(52) U.S. Cl.
USPC ..... 273/148 B; 248/918; 248/118

(58) Field of Classification Search
USPC ..... 273/148 B; 463/46, 47; 248/118, 248/118.1, 118.3, 118.5, 918
See application file for complete search history.

(56) References Cited

U.S. PATENT DOCUMENTS

| | | | | |
|---|---|---|---|---|
| 6,161,805 | A * | 12/2000 | Wells | 248/118 |
| 6,446,920 | B1 | 9/2002 | Wells et al. | |
| 7,673,879 | B2 * | 3/2010 | Collings | 273/148 R |
| 2005/0032578 | A1 | 2/2005 | Cole | |
| 2006/0281559 | A1 * | 12/2006 | Luciano | 463/46 |
| 2008/0113740 | A1 * | 5/2008 | McGahn et al. | 463/20 |
| 2008/0261703 | A1 | 10/2008 | Luciano et al. | |

FOREIGN PATENT DOCUMENTS

| | | |
|---|---|---|
| JP | A-10-052528 | 2/1998 |
| JP | A-10-080543 | 3/1998 |
| JP | A-2006-116119 | 5/2006 |

* cited by examiner

*Primary Examiner* — Raleigh W Chiu
(74) *Attorney, Agent, or Firm* — Oliff & Berridge, PLC

(57) ABSTRACT

A gaming machine comprising a user interface and a wrist support and hand grip. The wrist support and hand grip are useable in a first position while griping the hand grip, and in a second position while gripping the wrist support, while facilitating manipulation of one or more input devices at either position.

14 Claims, 14 Drawing Sheets

WRIST SUPPORT AND HAND GRIP

FIELD OF THE INVENTION

The present invention relates to peripheral input devices for computers and video game consoles. More particularly the invention is concerned with the ergonomics of the user interface of gaming machines, in the form of wrist support and hand grip.

BACKGROUND OF THE INVENTION

The ever growing popularity and use of computer and console video games (gaming machines and consoles), requires attention to design and functionality of the game controllers themselves with specific care to the human interface, i.e. ergonomics.

Much has been written about user interface which fail to meet the variety of needs associated with the video gaming public. For example, the stresses and fatigue placed upon gaming machine users may result in dissatisfaction, short sessions at the gaming arena and prolonged use may even results in Carpal tunnel syndrome and related health risks. Stress to the joints and ligaments and tendons of the shoulder, arm, forearm, hands and wrists are common.

Thus, there is a definite need for improved ergonomics in relationship to gaming machines.

SUMMARY OF THE INVENTION

According to the present invention there is provided an ergonomic grip and support assembly useful for various user interfaces. According to one particular application, there is provided a wrist support and hand grip for a gaming machine.

The invention provides, according to one of its aspects, a gaming machine comprising a user interface and a wrist support and hand grip; said wrist support and hand grip useable in a first position while griping the hand grip, and in a second position while gripping the wrist support; while facilitating manipulation of one or more input devices at either position.

It is appreciated that the term input device, as used herein the specification and claims denotes any form of input device, such as push buttons, knobs of different types (push/rotate, etc.) touch screen, and the like.

Any one or more of the following features and designs may be incorporated in the present invention:

- the user interface is a plurality of push-buttons;
- the input device is thumb or finger operated;
- the hand grip is in the form of a bent bar having at least a first bar portion extending substantially horizontally;
- the first bar portion extends substantially parallel to the wrist support;
- the first bar portion extends substantially parallel to a display of the gaming machine;
- the first bar portion has a length at least corresponding with the width of an average individual's palm;
- the hand grip has a second bar portion extending from the first bar portion in a direction away from wrist support;
- a cavity extends under the wrist support, to facilitate griping thereof;
- the wrist support is positioned such that while gripping at the hand grip the individual's wrist rests over said wrist support;
- the hand grip is positioned so that the first bar portion extends adjacent a first thumb operated knob, for use at the first position;

- the wrist support is positioned adjacent a second thumb operated knob, for use at the second position;
- the hand grip is positioned such that it may be used in a third position while an index finger of the user manipulates the second thumb operated knob and the thumb manipulates the first thumb operated knob, whilst the remaining fingers grip the hand grip;
- the wrist support is made of a hard material or is cushioned;
- one or both of the wrist support and hand grip are detachably attachable to the gaming machine.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1:
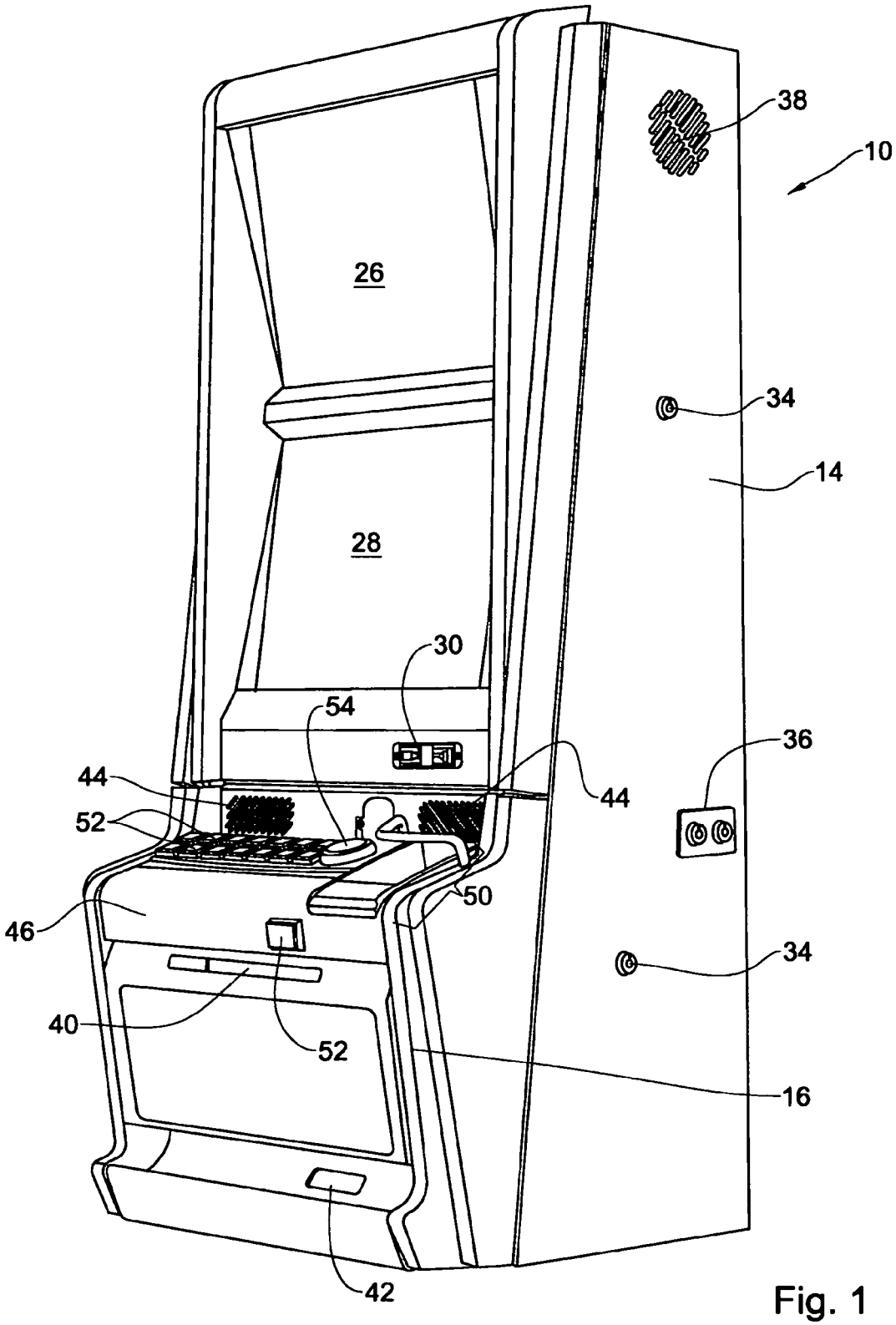
FIG. 1 is a right side isometric view of a gaming machine fitted with an arm wrist and support according to the present example.

Attention is first directed to FIG. 1 of the drawings illustrating a gaming machine in accordance with an example of the present invention generally designated 10. The gaming machine comprises a floor mounted main cabinet 12 fitted with a base unit 16 in the form of a lower door, and a main door 18 on the front of the machine, both being pivotally secured by hinges (not seen) to the main cabinet 12 and are openable to provide access to the interior of the machine.

A pair of video display monitors 26 and 28 are provided (mounted on a separate pivotable door extending behind the main door 18) and a card slot 30 (e.g. a credit card reader). Fitted on the side wall 14 there are a key activated door lock 34 and key activated switches for administration purposes 36, as well as a vent grate 38 for exhaustion of hot air from the machine's interior.

Fitted on the main door 18 comprises a coin/slot scepter 40 and a coin/slot tray 42 as well as a pair of speakers 44. Further mounted on the base unit 16 an operating panel generally designated 50 and comprises a plurality of push button 52 for use at user's choice. There is further provided an elongated wrist panel 46 to allow an individual to support his wrist and rest thereupon.

As can further be seen in more detail in the remaining FIGS. 2 to 4, the base unit 16 is provided with a wrist support and hand grip collectively designated 50 positioned so as to interact with two main push buttons namely 52 and 54.

Figure 3A:
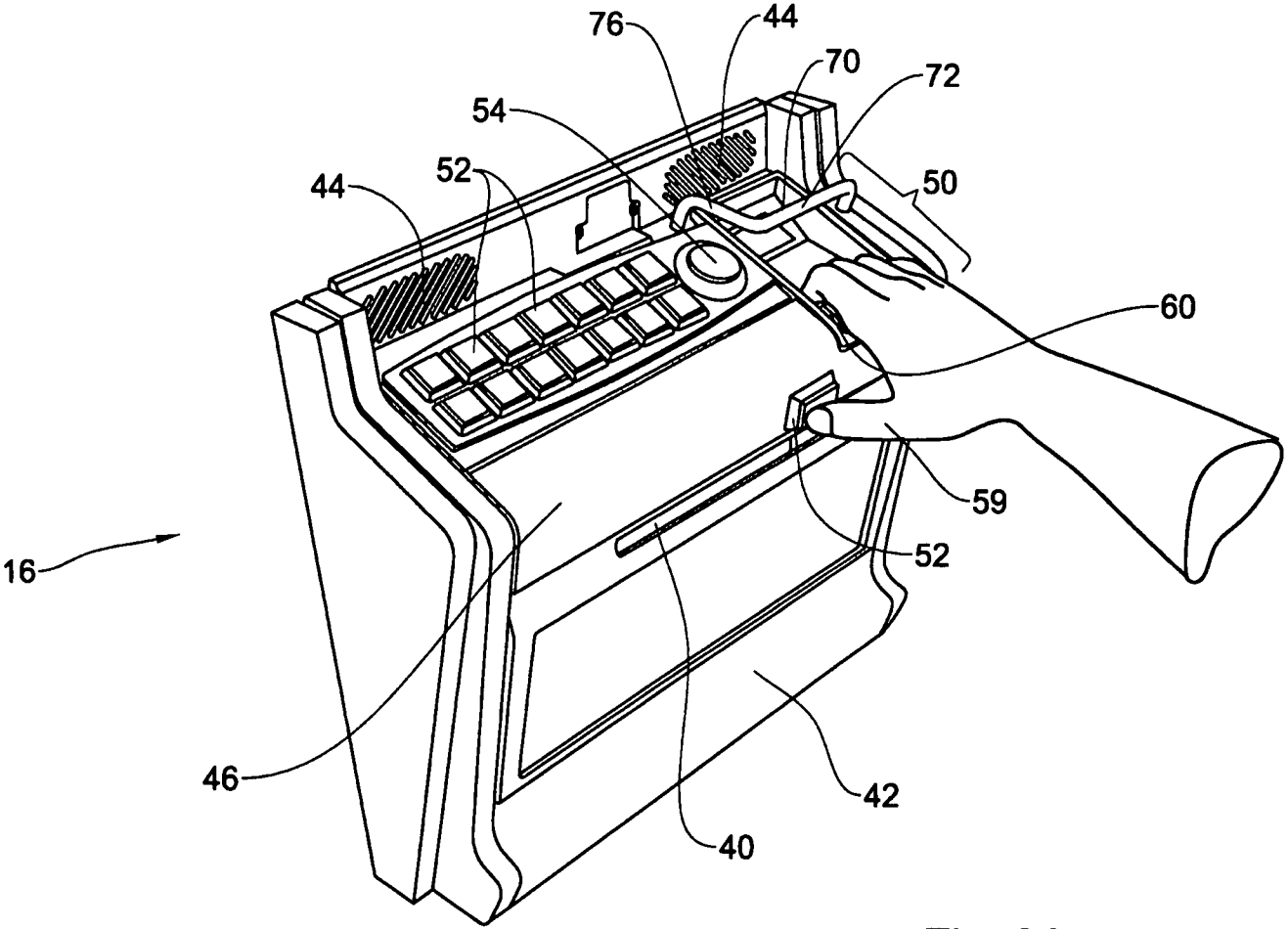
FIG. 3A is an isometric view illustrating a first operating position while gripping the wrist support.
Figure 3B:
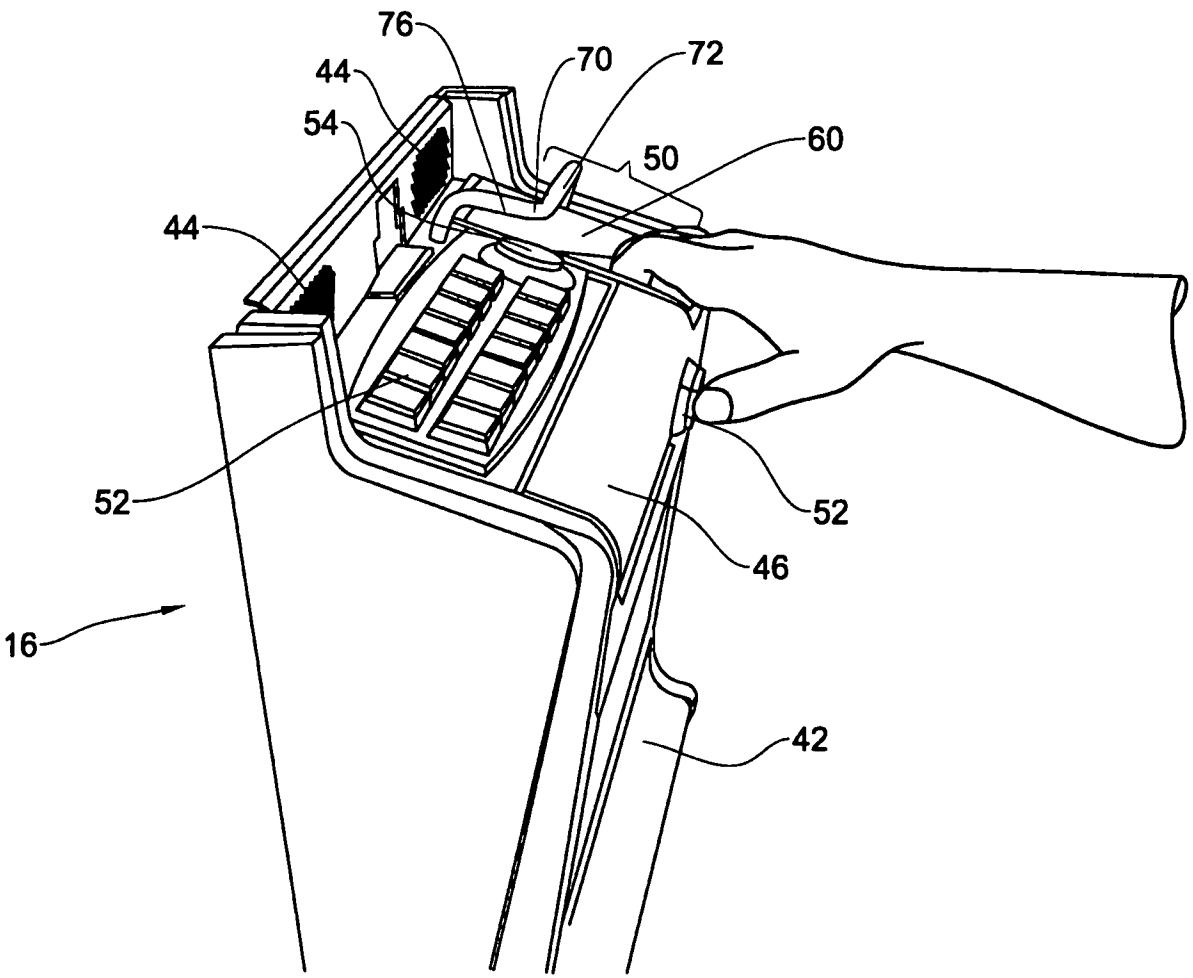
FIG. 3B is a side view of FIG. 3A.
Figure 3C:
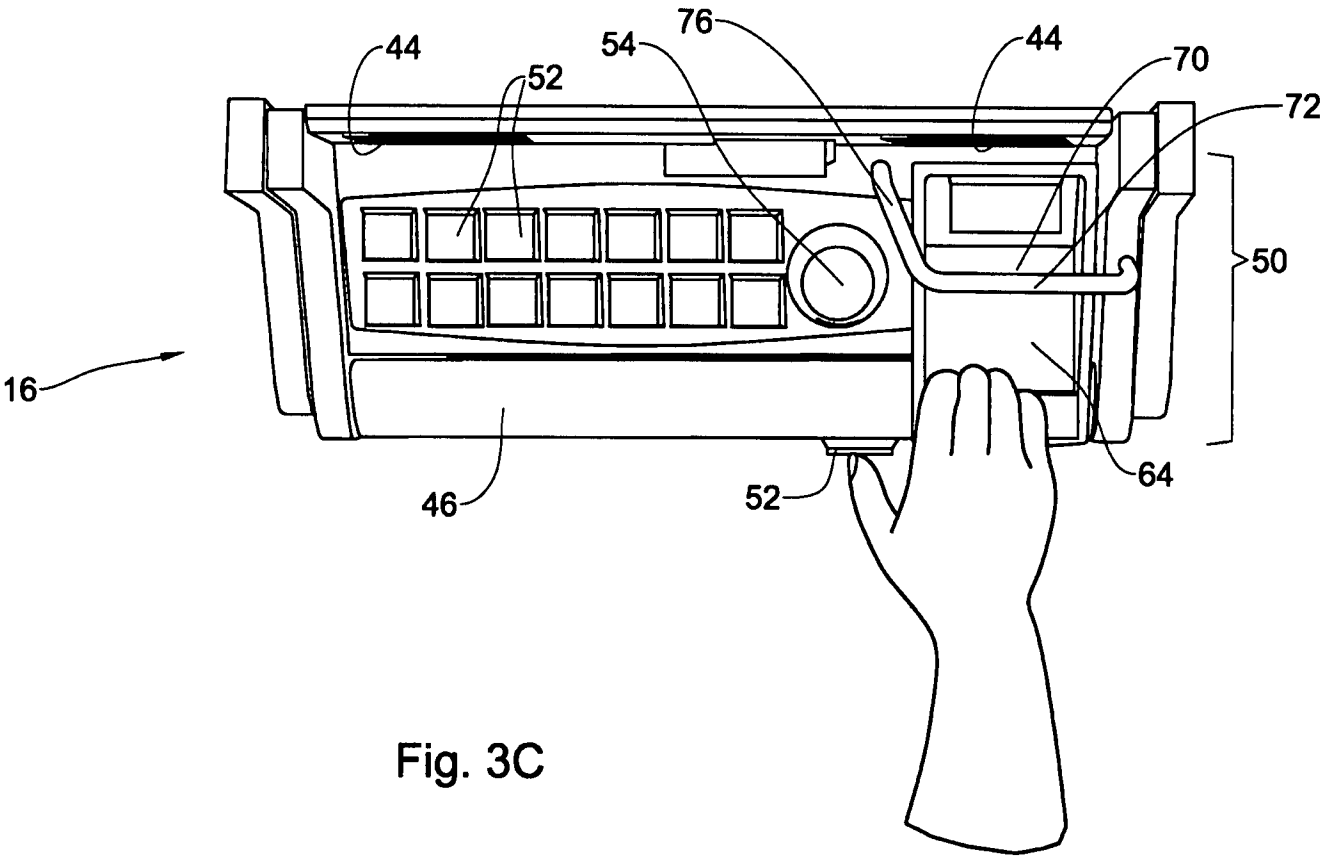
FIG. 3C is a top view of FIG. 3A.

The wrist support and hand grip 50 comprise a wrist support in the form of a wrist support 60 extending at the edge of a depression 62 with a cavity 64 formed under the wrist support 60 to facilitate gripping thereof as illustrated in FIGS. 3A to 3C (in the so-called second position). Wrist support 60 may be made of hard material e.g. a molded plastic martial, metal, etc. or it may be cushioned and comprise at least a layer of soft material.

Figure 4A:
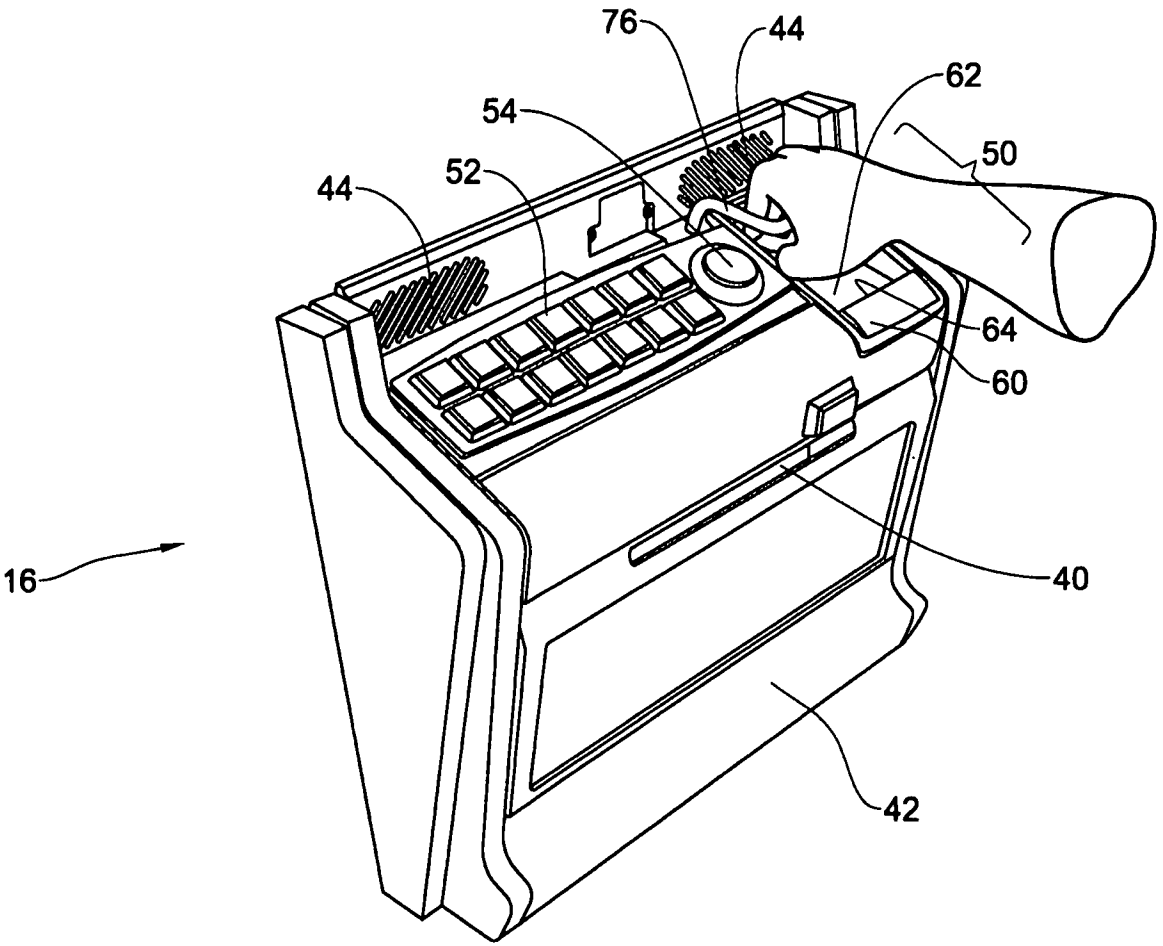
FIG. 4A is an isometric view illustrating a second operating position while gripping the hand grip.
Figure 4B:
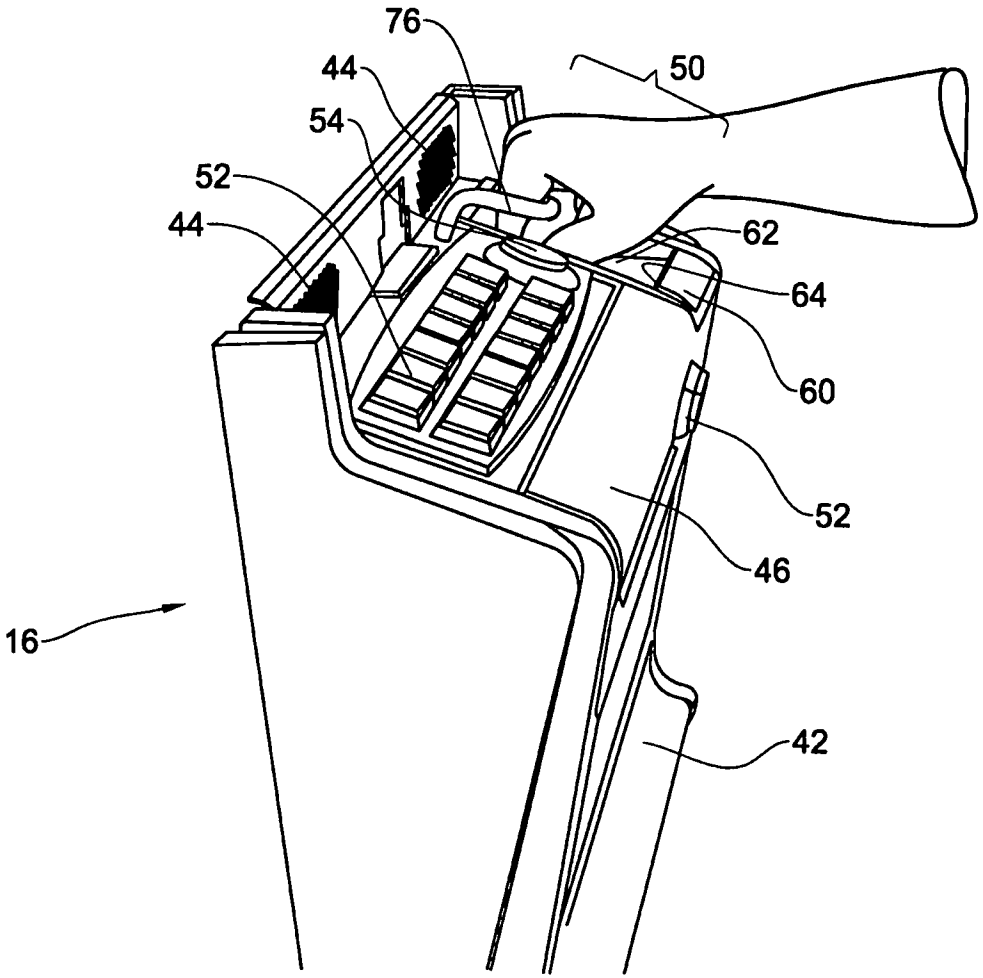
FIG. 4B is a side view of FIG. 4A.
Figure 4C:
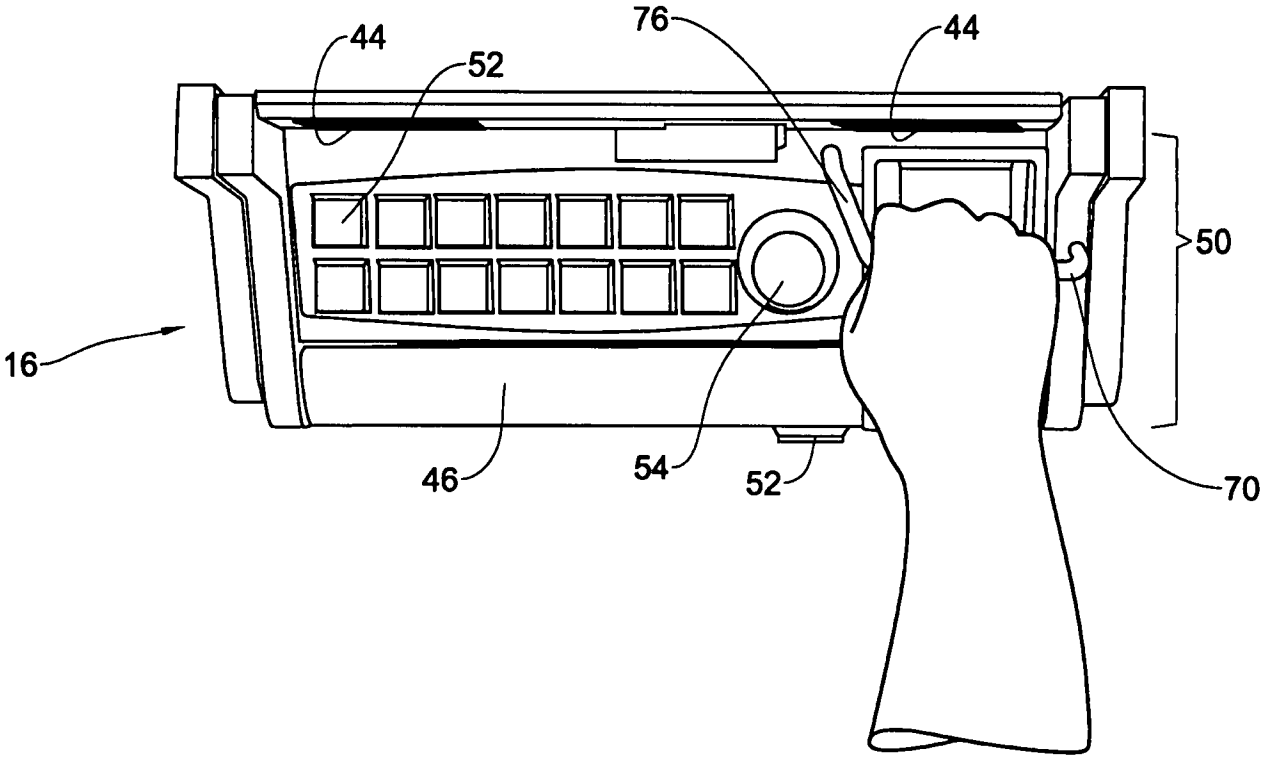
FIG. 4C is a top view of FIG. 4A.

A hand grip 70 extends in alignment with the wrist support 60, said hand grip 70 being in the form of a bent bar having a first portion 72 extending substantially horizontally and substantially parallel to the video displays (FIG. 1), with a second bar portion 76 extending from the first bar portion 72 in the direction away from the wrist support 60, suitable for serving as a sun rest. The hand grip 70 is used in accordance with the so-called first position (as illustrated in FIGS. 4A to 4C).

As can be seen in FIGS. 3A to 3C, the second position is used in conjunction with push button 52 easily engageable by the individual's thumb 59 whilst fingers grip the wrist support pad 60. However, in the so-called first position (FIGS. 4A-4C), push button 54 is easily engageable by individual's thumb whilst gripping on a first bar portion 72 with the individual having the choice of resting his wrist over the cushioned wrist support 60. While at the first position, the individual may opt to position his arm such that his wrist rests over the wrist support 60.

Figure 5A:
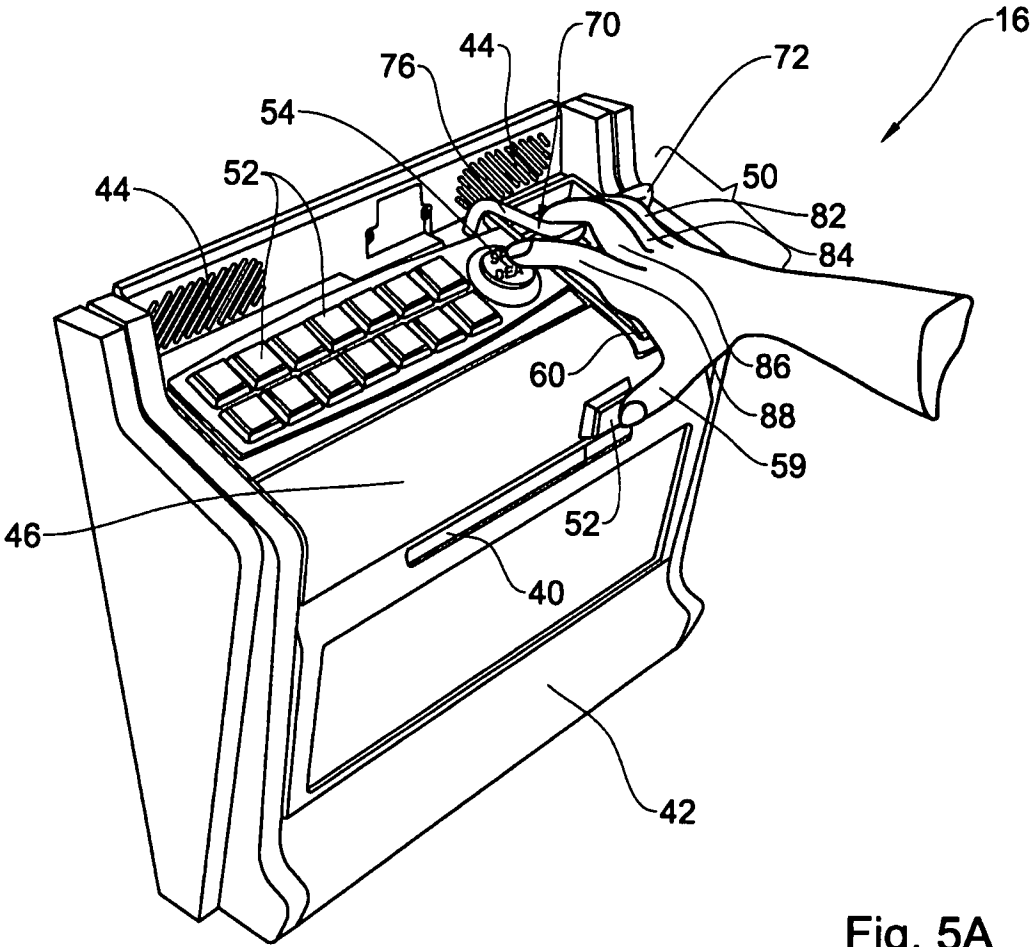
FIG. 5A is an isometric view illustrating a third operating position while gripping the wrist support.
Figure 5B:
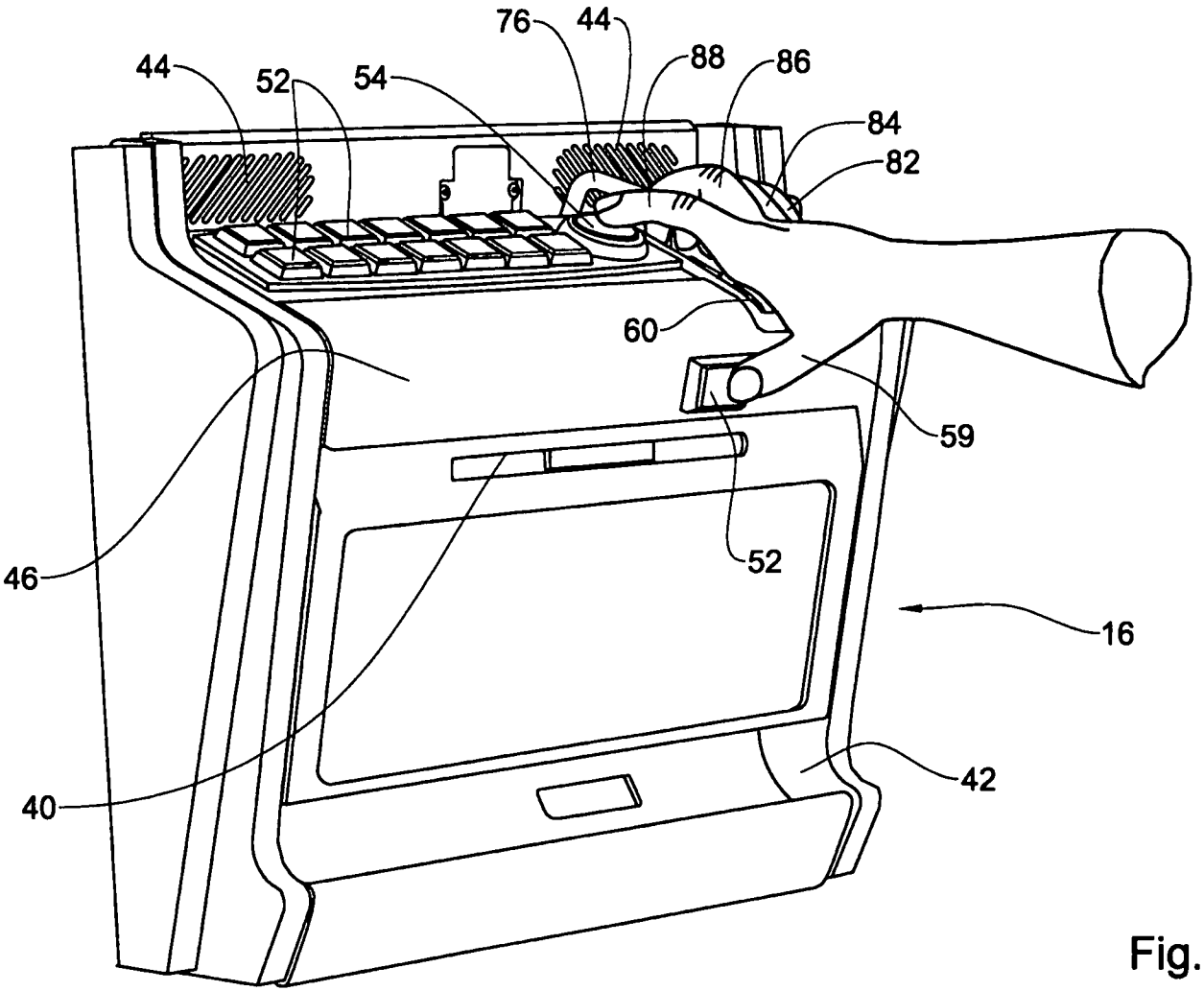
FIG. 5B is a front view of FIG. 5A.
Figure 5C:
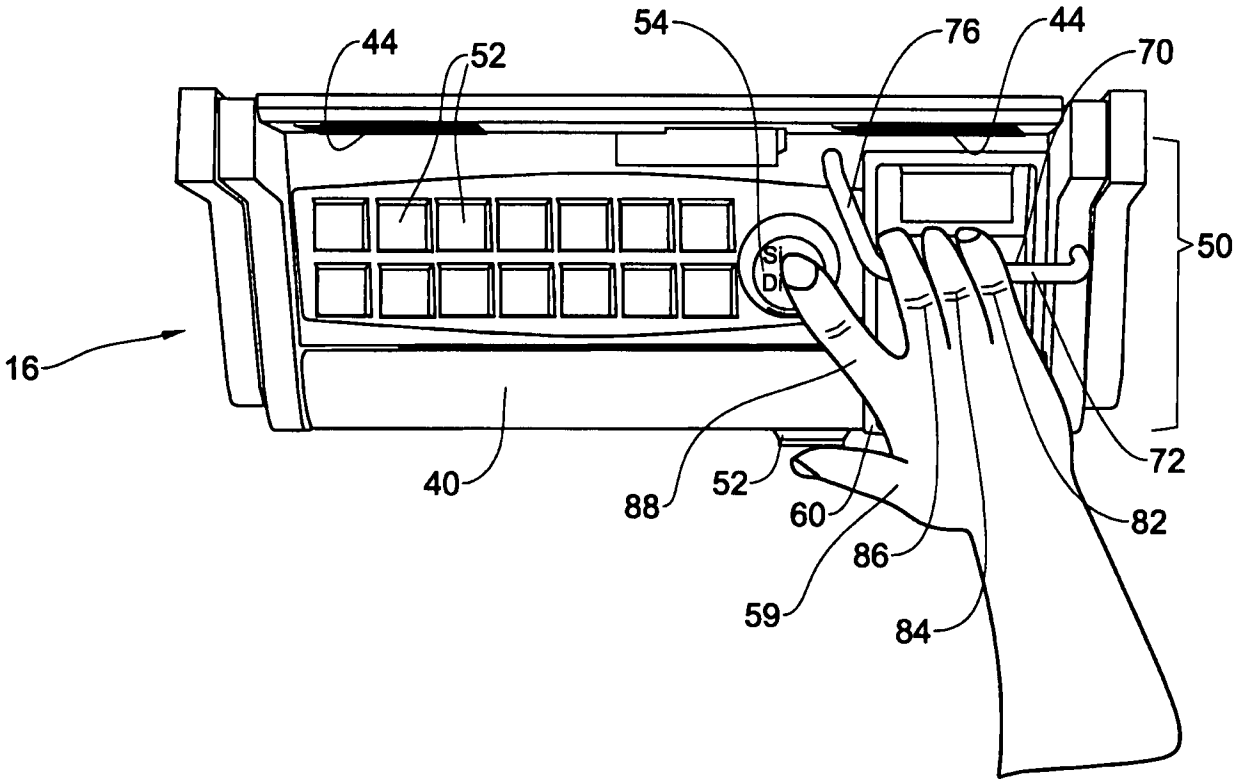
FIG. 5C is a top view of FIG. 5A.

With further reference to FIGS. 5A to 5C there is illustrated a third operating position, wherein three fingers of the individual, namely the little finger, ring finger and middle finger grip the bar section 72 whilst the index finger 88 manipulates push button 54 and the thumb 59 manipulates push button 52 and the open palm portion rests over wrist support 60.

Figure 2A:
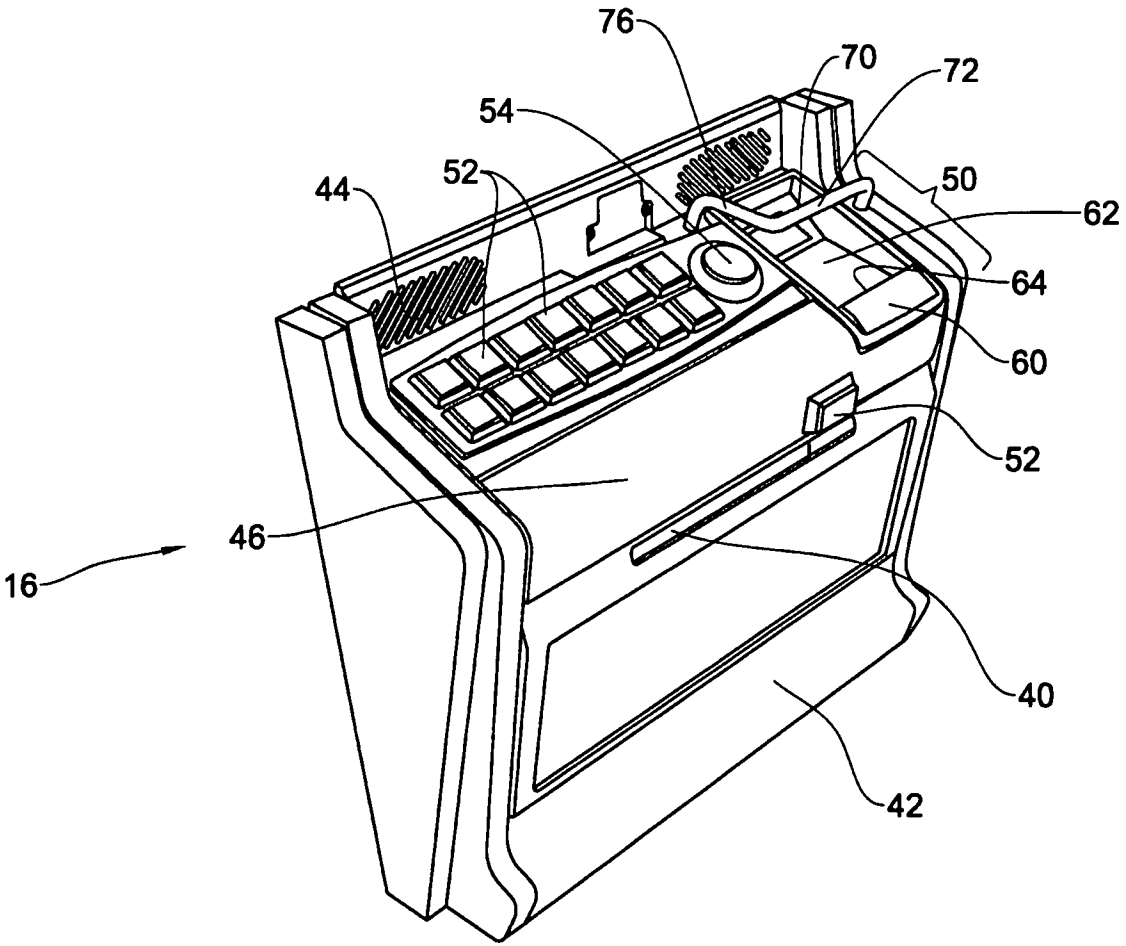
FIG. 2A is an isometric representation of the user interface of the gaming machine of FIG. 1.
Figure 2B:
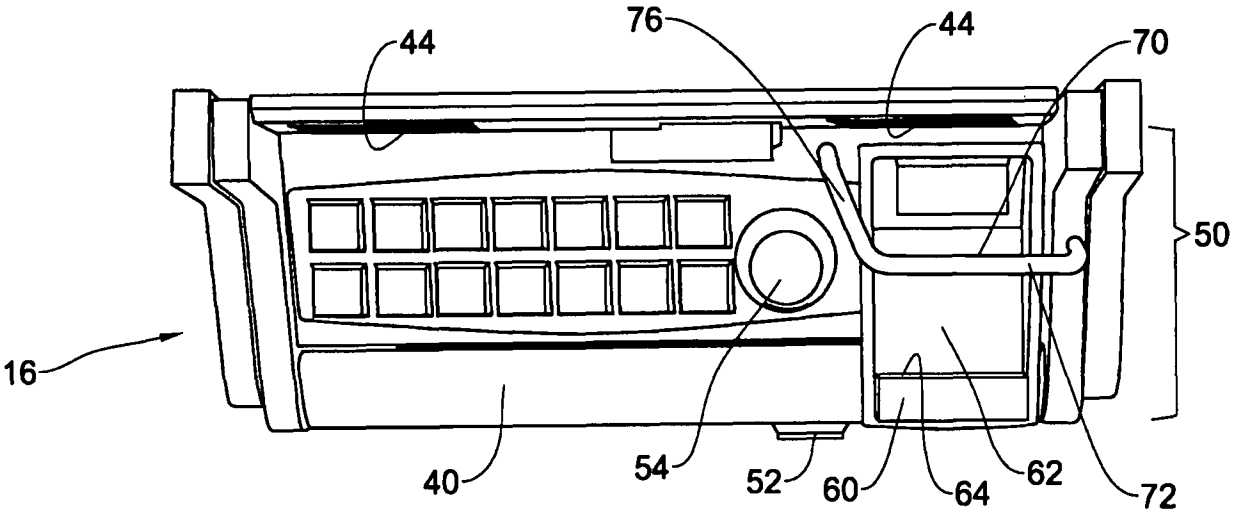
FIG. 2B is a top view of the user interface of the gaming machine of FIG. 1.
Figure 2C:
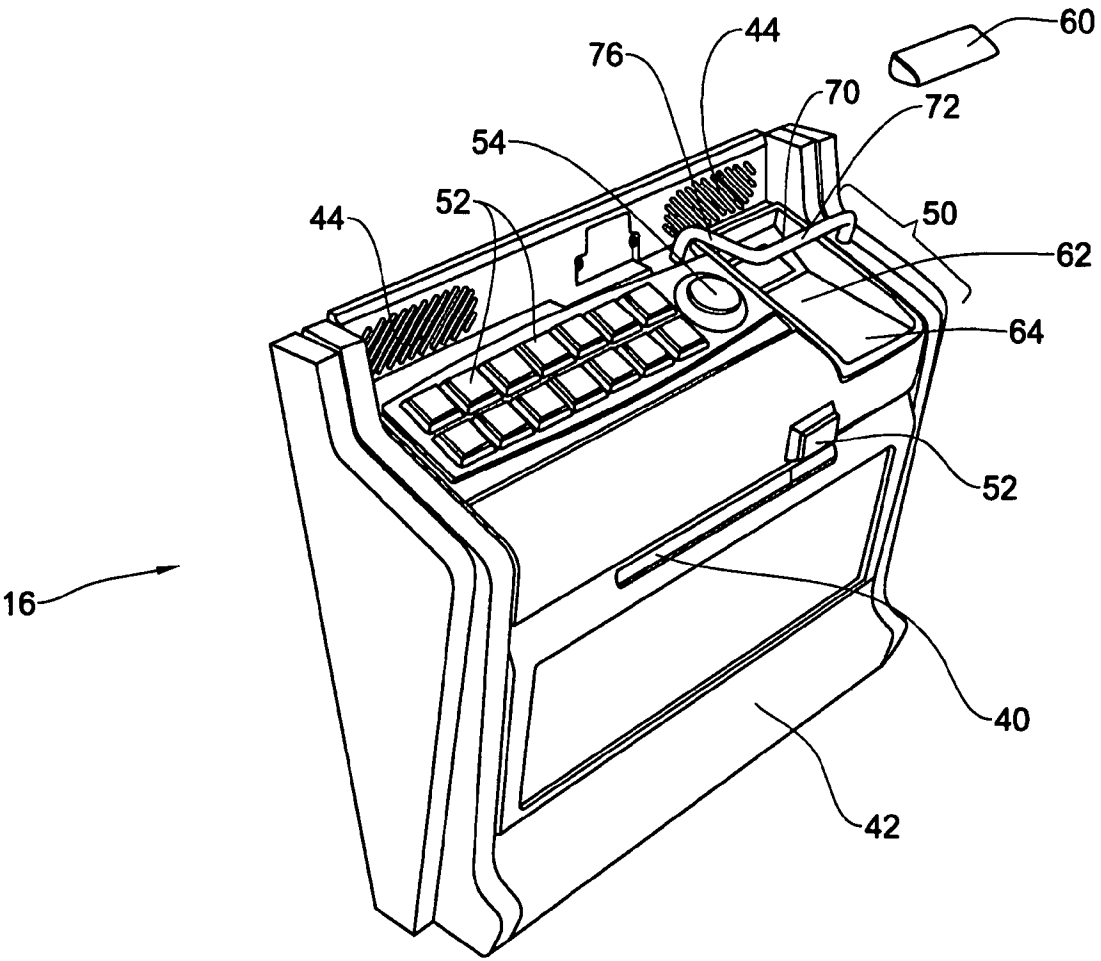
FIG. 2C is the same as FIG. 2A, illustrated with the wrist support removed.
Figure 2D:
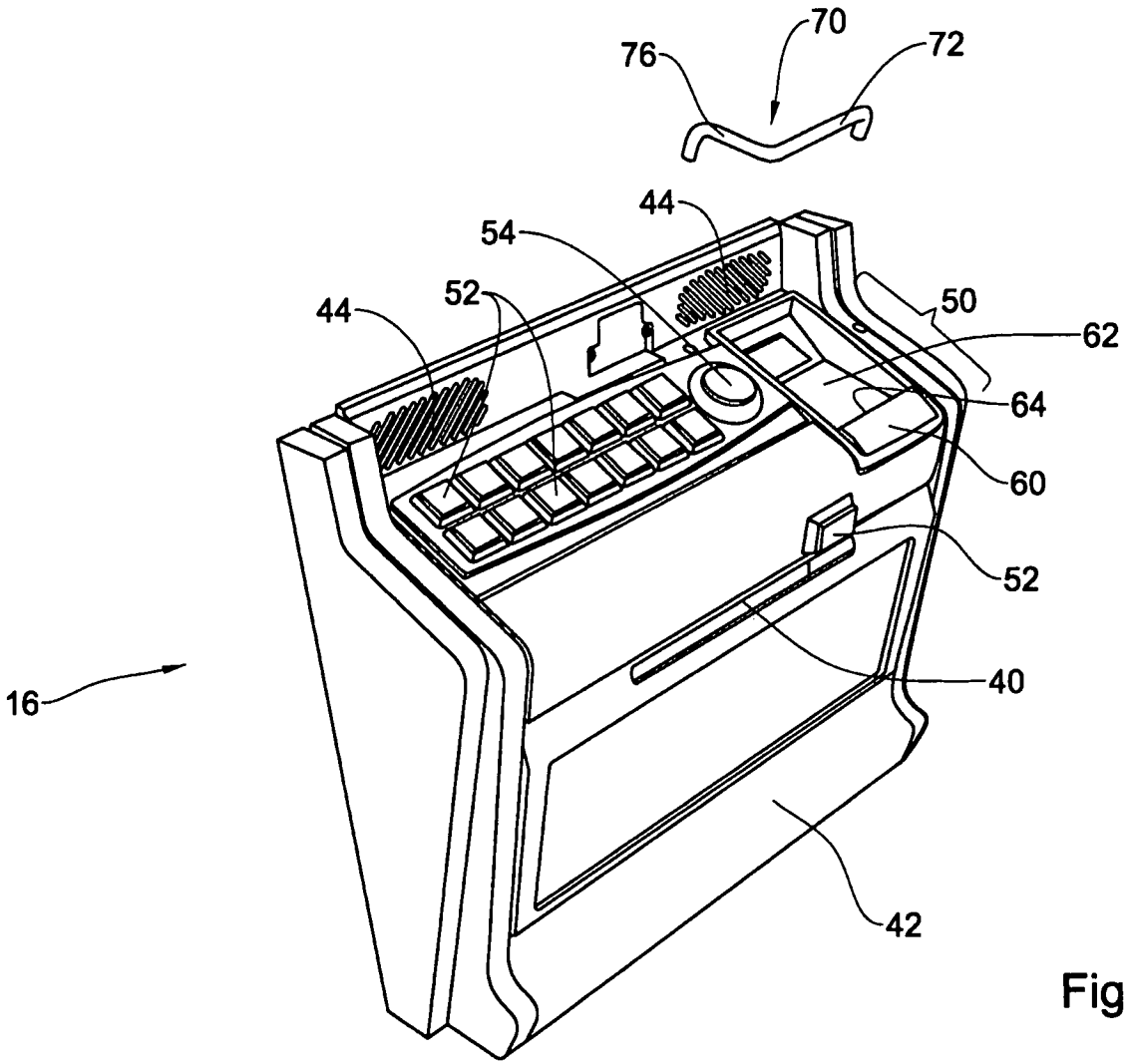
FIG. 2D is the same as FIG. 2A, illustrated with the hand grip removed.

As can be seen in FIG. 2C, the wrist support 60 is detachably attachable to the base unit 16, at user's/operator's choice. Likewise, as illustrated in FIG. 2D, the hand grip 70 is detachably attachable as well.

Those skilled in the art to which this invention pertains will readily appreciate that numerous changes, variations, and modifications can be made without departing from the scope of the invention. Mutatis Mutandis.

The invention claimed is:

1. A gaming machine comprising a user interface and a wrist support and hand grip; said wrist support and hand grip useable in a first position while griping the hand grip, and in a second position while gripping the wrist support; while facilitating manipulation of one or more input devices at either position.

2. A gaming machine according to claim 1, wherein the user interface is a plurality of push-buttons.

3. A gaming machine according to claim 1, wherein the hand grip is in the form of a bent bar having at least a first bar portion extending substantially horizontally.

4. A gaming machine according to claim 3, wherein the first bar portion extends substantially parallel to the wrist support.

5. A gaming machine according to claim 3, wherein the first bar portion extends substantially parallel to a display of the gaming machine.

6. A gaming machine according to claim 3, wherein the first bar portion has a length at least corresponding with the width of an average individual's palm.

7. A gaming machine according to claim 3, wherein the hand grip has a second bar portion extending from the first bar portion in a direction away from wrist support.

8. A gaming machine according to claim 3, wherein the hand grip is positioned so that the first bar portion extends adjacent a first thumb operated knob, for use at the first position.

9. A gaming machine according to claim 3, wherein the wrist support is positioned adjacent a second thumb operated knob, for use at the second position.

10. A gaming machine according to claim 3, wherein the hand grip is positioned so that it may be used in a third position wherein an index finger of the individual manipulates a second thumb operated knob and the thumb manipulates the first thumb operated knob, whilst the remaining fingers grip the hand grip.

11. A gaming machine according to claim 1, wherein a cavity extends under the wrist support, to facilitate griping thereof.

12. A gaming machine according to claim 1, wherein the wrist support is positioned such that while gripping at the hand grip the individual's wrist rests over the wrist support.

13. A gaming machine according to claim 1, wherein the wrist support is cushioned.

14. A gaming machine according to claim 1, wherein one or both of the wrist support and hand grip are detachably attachable to the gaming machine.

* * * * *